US009799982B1

(12) United States Patent
Lin

(10) Patent No.: US 9,799,982 B1
(45) Date of Patent: Oct. 24, 2017

(54) AUTO-POSITIONING STRUCTURE FOR UPPER COVER OF NETWORK PLUG

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/587,675

(22) Filed: May 5, 2017

(30) Foreign Application Priority Data

Oct. 21, 2016 (TW) ..... 105216049 U

(51) Int. Cl.

| | |
|---|---|
| ***H01R 13/506*** | (2006.01) |
| ***H01R 24/64*** | (2011.01) |
| ***H01R 13/627*** | (2006.01) |
| *H01R 107/00* | (2006.01) |

(52) U.S. Cl.
CPC ..... *H01R 13/506* (2013.01); *H01R 13/6272* (2013.01); *H01R 24/64* (2013.01); *H01R 2107/00* (2013.01)

(58) Field of Classification Search
CPC .. H01R 13/506; H01R 24/64; H01R 2107/00; H01R 9/2425; H01R 13/6271; H01R 13/6272
USPC ... 439/676, 357, 358, 620.21, 668, 680, 681
See application file for complete search history.

(56) References Cited

U.S. PATENT DOCUMENTS

| | | | | |
|---|---|---|---|---|
| 6,174,190 | B1 * | 1/2001 | Tharp | H01R 13/6272 439/352 |
| 6,364,685 | B1 * | 4/2002 | Manning | G02B 6/3879 439/354 |
| 7,297,013 | B2 * | 11/2007 | Caveney | H01R 43/26 439/352 |
| 7,517,241 | B2 * | 4/2009 | Gundlach | H01R 13/6335 439/344 |
| 8,764,476 | B1 * | 7/2014 | Ma | H01R 4/2433 439/418 |
| 9,570,852 | B2 * | 2/2017 | Plamondon | H01R 13/6335 |
| 2004/0247252 | A1 * | 12/2004 | Ehrenreich | G02B 6/3893 385/58 |

* cited by examiner

*Primary Examiner* — Tulsidas C Patel
*Assistant Examiner* — Travis Chambers
(74) *Attorney, Agent, or Firm* — Guice Patents PLLC

(57) ABSTRACT

An auto-positioning structure for an upper cover of a network plug includes a base having an upper end and a rear end and an upper cover having an end pivoted to the upper end and assembled with the base to form a main body. A front portion of a network cable is inserted into the main body. A circuit board cooperates with a piercing terminal seat and a press plate to assemble with the network cable. A releasing spring sheet is disposed on the upper cover, and a front base is disposed on the base and corresponding to the releasing spring sheet. An unlock spring sheet is disposed on the front base and facing the releasing spring sheet, wherein the releasing spring sheet pushes the unlock spring sheet when the upper cover is lifted, and the upper cover is positioned when it reaches a predetermined angle.

4 Claims, 6 Drawing Sheets

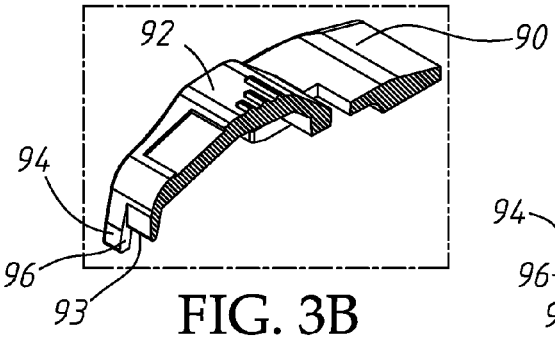
FIG. 3B
FIG. 3A
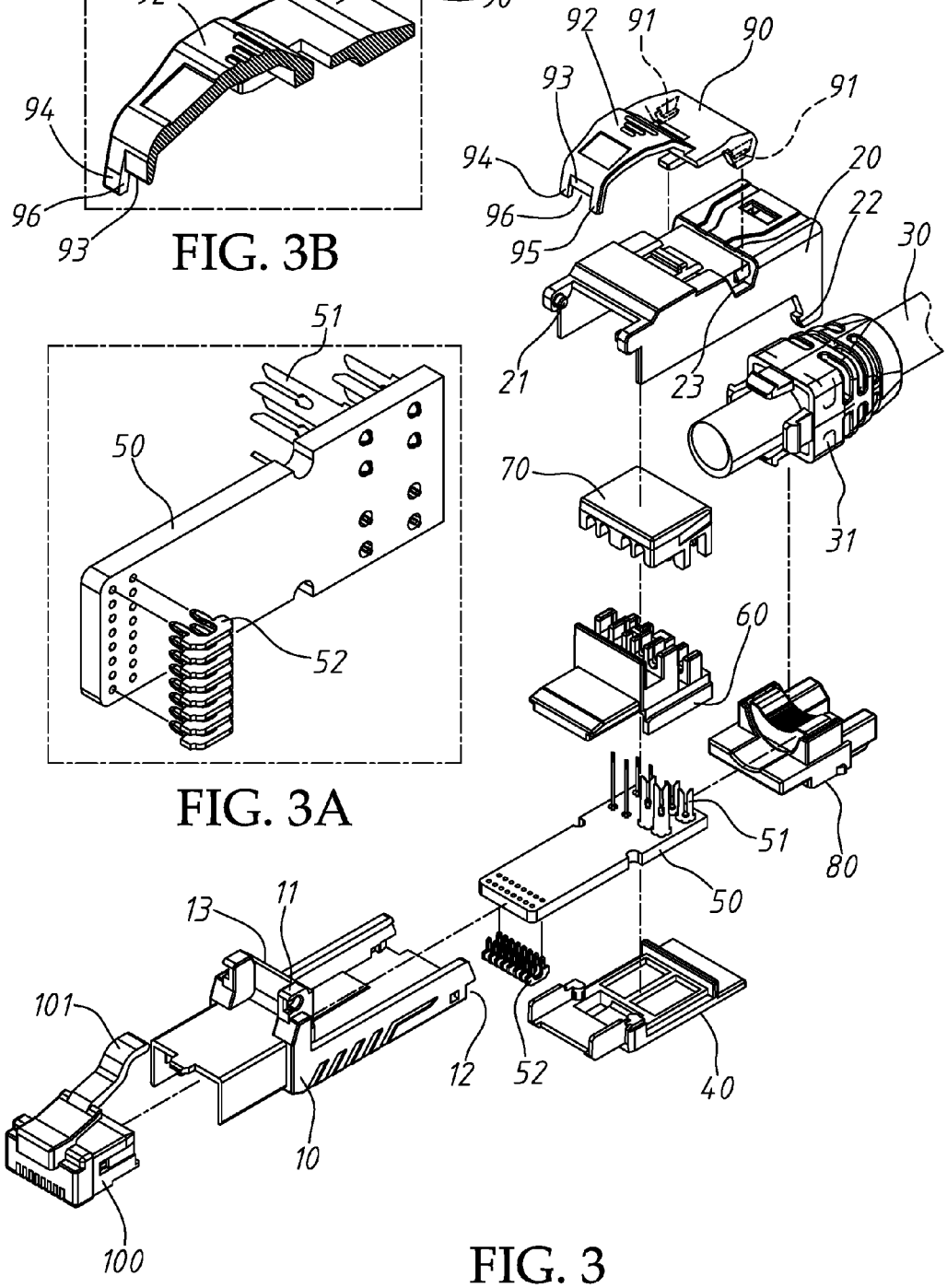
FIG. 3

AUTO-POSITIONING STRUCTURE FOR UPPER COVER OF NETWORK PLUG

BACKGROUND OF THE INVENTION

Field of the Invention

The invention relates to an auto-positioning structure for an upper cover of a network plug for automatically positioning the upper cover during a core wire assembly process and facilitating plug or unplug of the network plug.

Description of the Related Art

A network cable usually includes eight core wires internally. The network cable is configured to extend through a jacket to enter a network plug. The core wires are peeled and electrically connected to piercing terminals in the network plug. The network plug can be inserted into a network socket. Each piercing terminal contacts a corresponding terminal in the socket for transmitting signals through the core wires. Every two core wires of the eight core wires are twisted together to form four pairs of twisted core wires.

The mentioned network cable is assembled to a network plug as shown in FIG. 1. The network plug includes a base 1000 and an upper cover 1001 to form a plug main body. The base 1000 has a plug head 1002 and a tilted spring sheet 1003 disposed on the plug head 1002 for assemble or disassemble the network plug. A portion of the network cable 1004 is inserted into the network plug, and the peeled core wires are electrically connected to the piercing terminals and positioned therein.

The upper cover 1001 is pivoted to the base 1000 at a pivot portion, and the upper cover 1001 can be lifted or closed with respect to the pivot portion. The upper cover 1001 must be lifted as shown in FIG. 1 when the network cable 1004 is assembled. Since the upper cover 1001 is pivoted to the base 1000, the lifted upper cover 1001 may rotate back to its original position when no support force exerts. An operator must hold the upper cover 1001 with one hand and assemble the network cable to the network plug with the other hand. It is thus inconvenient and takes much time. The tilted spring sheet 1003 is thinner and not easily pressed by a thicker finger of the operator. On the other hand, the network plug is often used in a device having a crowded layout, and pressing the tilted spring sheet 1003 often causes a problem of plugging or unplugging the network plug in such a narrow space.

BRIEF SUMMARY OF THE INVENTION

An object of the invention is to provide an auto-positioning structure for an upper cover of a network plug for facilitating plug or unplug of the network plug in a narrow space.

Another object of the invention is to provide an auto-positioning structure for an upper cover of a network plug for operating the assembly process of the core wires without holding the upper cover through fingers.

The invention provides an auto-positioning structure for an upper cover of a network plug. The auto-positioning structure in accordance with an exemplary embodiment of the invention includes a base having a upper end and a rear end; an upper cover having an end pivoted to the upper end and assembled with the base to form a main body; a network cable including a plurality of core wires, wherein a front portion of the network cable is inserted into the main body; a base plate mounted to the base, wherein a circuit board is positioned on the base plate and a piercing terminal seat and a press plate are disposed above the circuit board; a lead seat mounted to the rear end for positioning the front portion of the network cable; a releasing spring sheet disposed on the upper cover; a front base disposed on the base and corresponding to the releasing spring sheet; an unlock spring sheet disposed on the front base and facing the releasing spring sheet, wherein the releasing spring sheet pushes the unlock spring sheet when the upper cover is lifted, and the upper cover is positioned when it reaches a predetermined angle.

In another exemplary embodiment, the releasing spring sheet includes a latching device disposed on a rear end of the releasing spring sheet and configured to assemble with a latching element disposed on the upper end of the upper cover and a curved portion extending to a press front portion.

In yet another exemplary embodiment, the press front portion includes two extending tabs to form a press notch corresponding to a width of the unlock spring sheet, the press notch holds the unlock spring sheet, and the press front portion presses the unlock spring sheet.

In another exemplary embodiment, the upper cover includes two pivot portions pivoted to two pivot seats of the base, and a middle plate is disposed between the pivot seats to engage the extending tabs.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 3 is an exploded view of FIG. 2;

FIG. 3A is an enlarged exploded view of a circuit board of FIG. 3;

FIG. 3B is a partially enlarged cross section of a releasing spring sheet of FIG. 3;

DETAILED DESCRIPTION OF THE INVENTION

Figure 1:
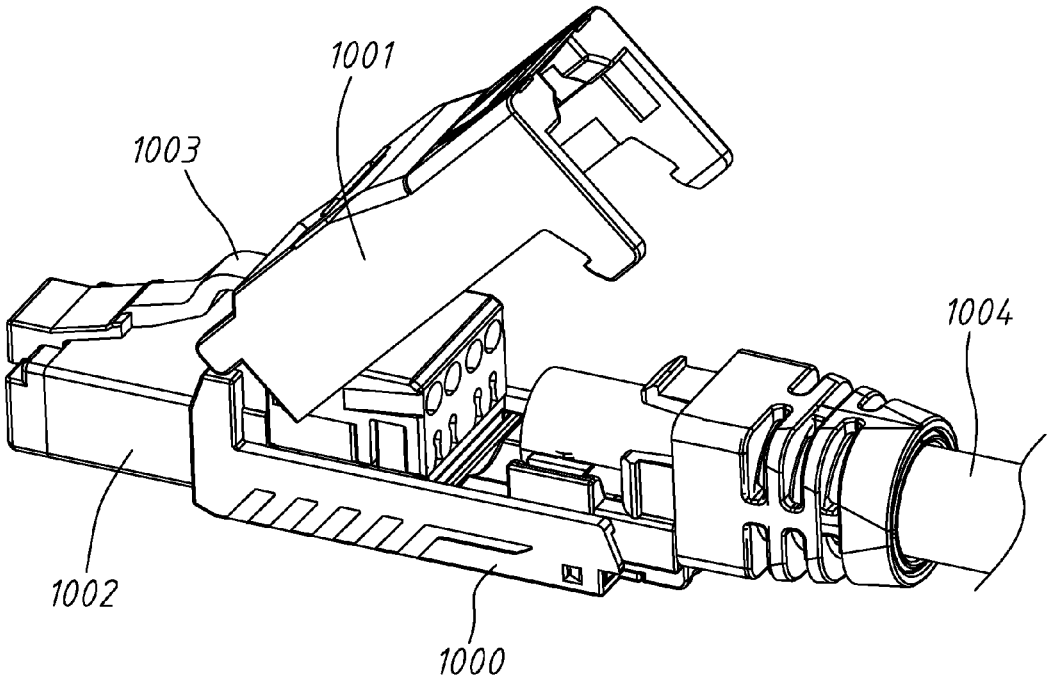
FIG. 1 PRIOR ART
FIG. 1 depicts a conventional network plug, wherein an upper cover is lifted.
Figure 2:
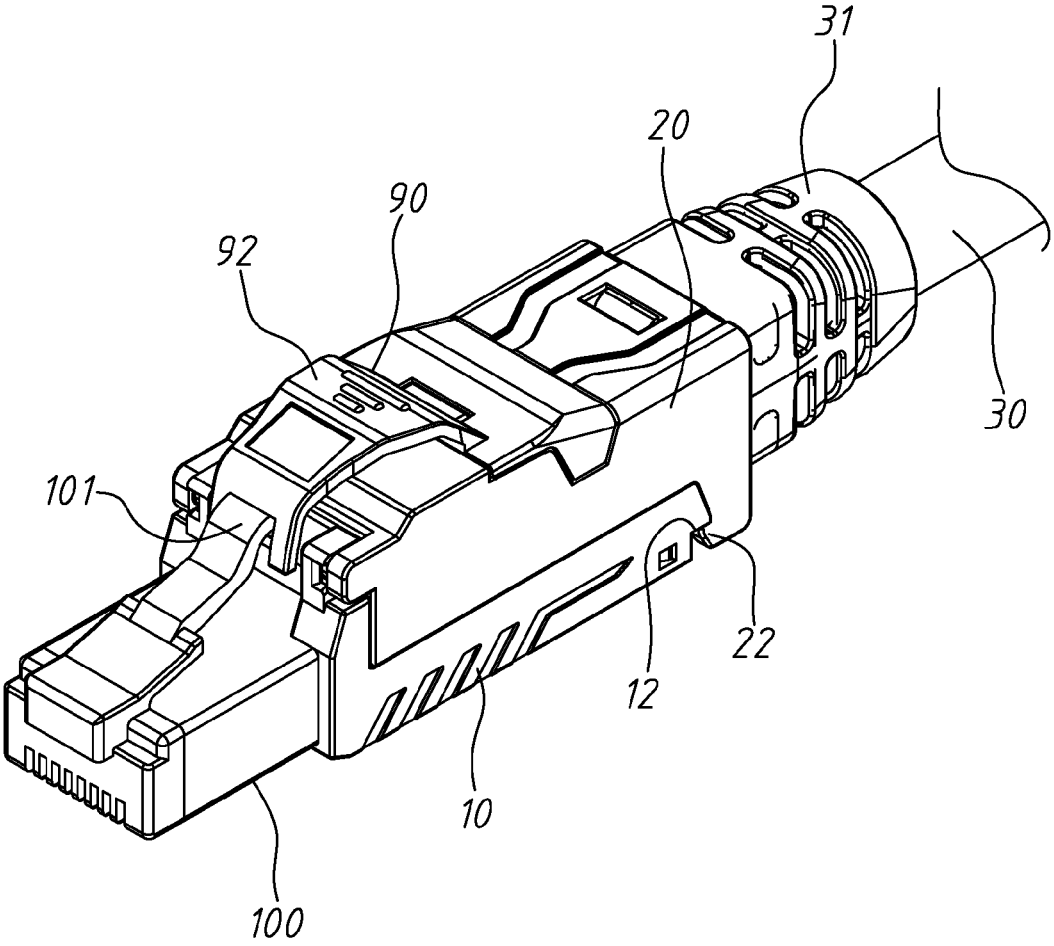
FIG. 2 is a perspective view of an embodiment of a positioning structure for an upper cover of a network plug of the invention.
Figure 4:
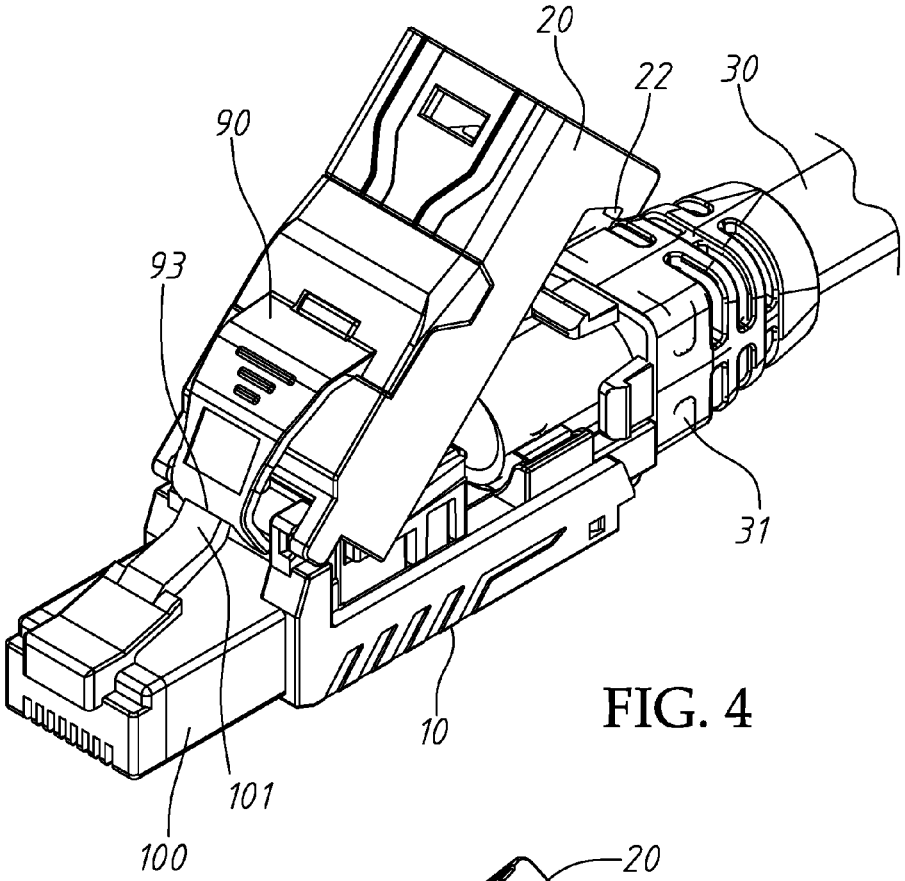
FIG. 4 depicts the upper cover of FIG. 1 being lifted.
Figure 5:
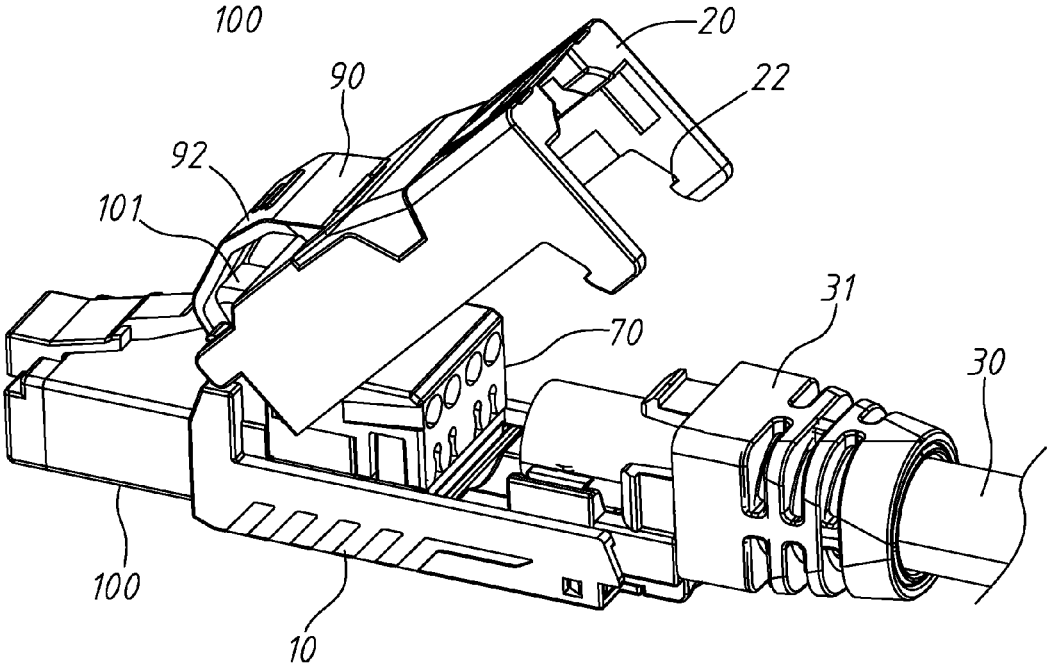
FIG. 5 depicts the lifted upper cover of FIG. 4 viewed from another angle.

The following description is of the best-contemplated mode of carrying out the invention. This description is made for the purpose of illustrating the general principles of the invention and should not be taken in a limiting sense. The scope of the invention is best determined by reference to the appended claims.

Referring to FIGS. 2 to 5, a network plug of the invention includes a base 10 and an upper cover 20 having an end pivoted to an upper end of the base 10. The upper cover 20 and the base 10 form a main body of the network plug. A network cable 30 extends through a jacket 31, and a front portion of the network cable 30 is inserted into the main body. A base plate 40 is mounted to an inner surface of the base 10, and a circuit board (PCB) 50 is positioned on the base plate 40. A piercing terminal seat 60 is disposed on the circuit board 50, and a press plate 70 is disposed above the piercing terminal seat 60. A lead seat 80 is mounted to a rear end of the base 10 to position the front portion of the network cable 30. A releasing spring sheet 90 is disposed on the upper cover 20. A front base 100 corresponding to the releasing spring sheet 90 is disposed on the base 20. An unlock spring sheet 101 is disposed on the front base 100 and faces the releasing spring sheet 90.

The upper cover 20 includes two pivot portions 21 pivoted to two pivot seats 11 of the base 10. The upper cover 20 can be lifted or closed with respect to the pivot portions 21 and the pivot seats 11. The upper cover 20 further includes a middle plate 13 disposed between the pivot seats 11. The upper cover 20 has hooks 22 engaging notches 12 of the base 10. The network cable 30 includes eight core wires (not shown) connected to related elements in the main body. Several piercing terminals 51 are disposed on an upper surface of the circuit board 50 cooperated with the piercing terminal seat 60 and the press plate 70 to pierce the core wires of the cable 30. As shown in FIG. 3A, a row of conducting plates 52 of the same shape is disposed on a bottom surface of the circuit board 50.

Figure 7:
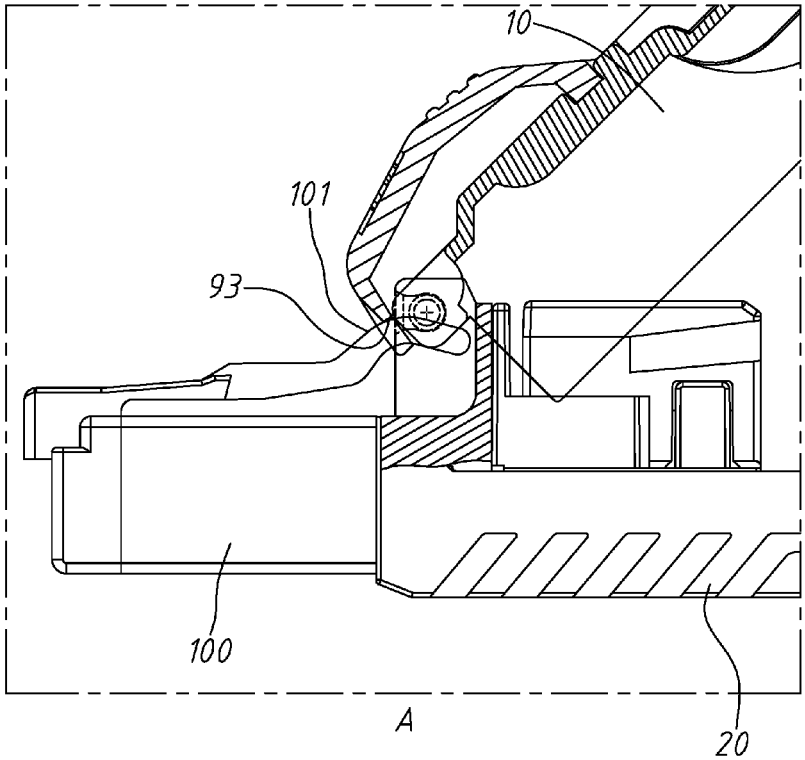
FIG. 7 is an enlarged view of portion A of FIG. 6.
Figure 6:
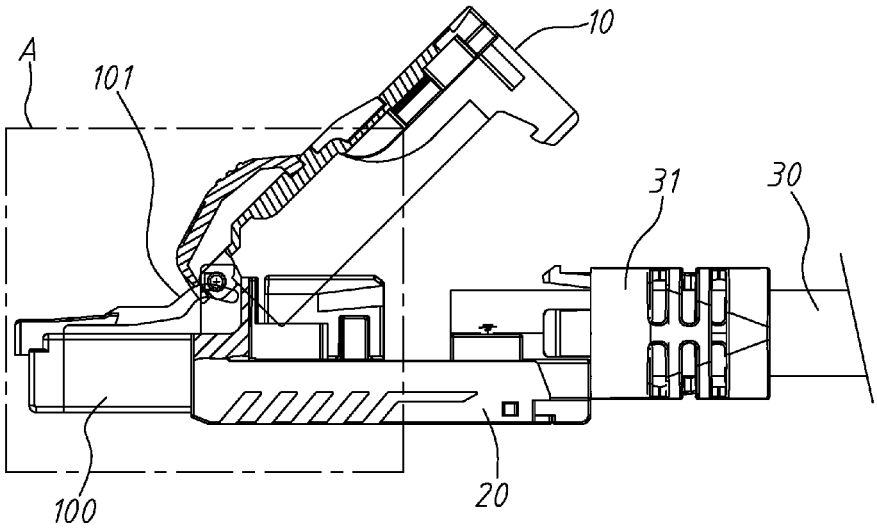
FIG. 6 is a partially cross section of the lifted upper cover of FIG. 4.

Referring to FIGS. 3, 6 and 7, the releasing spring sheet 90 has a latching device 91 and a curved portion 92. The latching device 91 is disposed on a rear end of the releasing spring sheet 90 and configured to assemble with a latching element 23 disposed on the upper end of the upper cover 20. The curved portion 92 extends to a press front portion 93. In this embodiment, the press front portion 93 includes two extending tabs 94 and 95 to form a press notch 96 having a U shape corresponding to a width of the unlock spring sheet 101, the press notch 96 holds the unlock spring sheet 101, and the press front portion 93 presses the unlock spring sheet 101.

Figure 9:
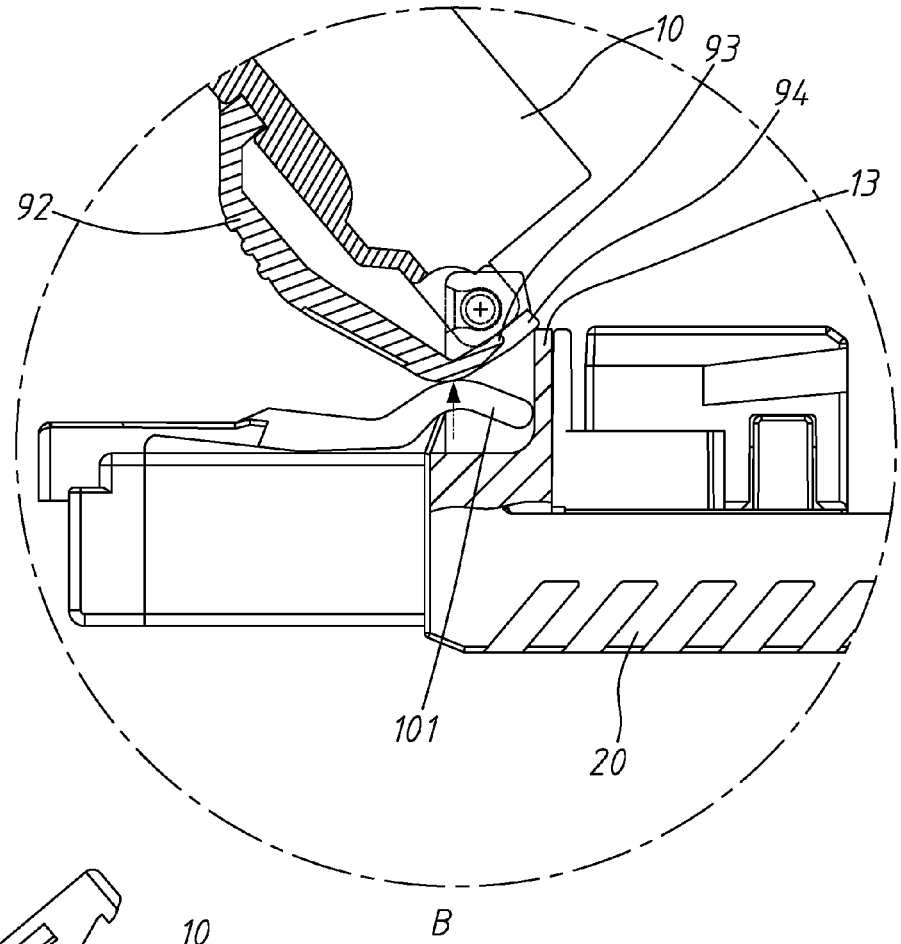
FIG. 9 is a partially enlarged view of FIG. 8.
Figure 8:
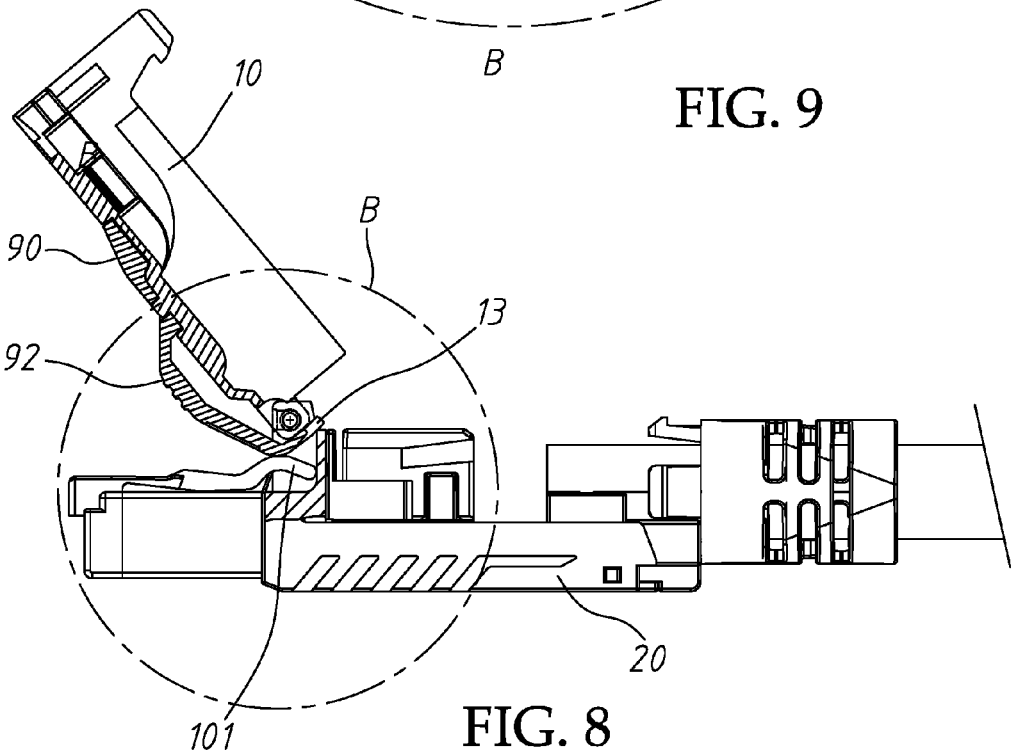
FIG. 8 depicts the upper cover of the network plug of the invention being lifted to a predetermined angle.

When the upper cover 20 is lifted as shown in FIGS. 6 and 7, the unlock spring sheet 101 is continuously pressed by the press front portion 93. When the upper cover 20 is lifted to a predetermined angle as shown in FIGS. 8 and 9, the U-shaped tip formed by the extending tabs 94 and 95 passes between the pivot seats 11 and engages the middle plate 13 or the extending tabs 94 and 95 engage a partition plate of the pivot seats 11. The unlock spring sheet 101 props against the upper cover 20 through a spring force generated by itself and thus automatically positions the upper cover 20 in an opened position. Therefore, it is convenient to operate the assembly process of the core wires without holding the upper cover 20 by fingers. Since the curved portion 92 of the releasing spring sheet 90 is in an upper surface, it is easily to push the curved portion 92 to move the unlock spring sheet 101 and thus release the insertion in a narrow space.

The invention provides an auto-positioning structure for an upper cover of a network plug, the network plug can be easily plugged or unplugged in a narrow space, and the assembly of core wires is more convenient.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A auto-positioning structure for an upper cover of a network plug, comprising:

a base having a upper end and a rear end;

an upper cover having an end pivoted to the upper end and assembled with the base to form a main body;

a network cable comprising a plurality of core wires, wherein a front portion of the network cable is inserted into the main body;

a base plate mounted to the base, wherein a circuit board is positioned on the base plate and a piercing terminal seat and a press plate are disposed above the circuit board;

a lead seat mounted to the rear end for positioning the front portion of the network cable;

a releasing spring sheet disposed on the upper cover;

a front base disposed on the base and corresponding to the releasing spring sheet; and an unlock spring sheet disposed on the front base and facing the releasing spring sheet, wherein the releasing spring sheet pushes the unlock spring sheet when the upper cover is lifted, and the upper cover is positioned when it reaches a predetermined angle.

2. The auto-positioning structure as claimed in claim 1, wherein the releasing spring sheet comprises a latching device disposed on a rear end of the releasing spring sheet and configured to assemble with a latching element disposed on the upper end of the upper cover, and a curved portion extending to a press front portion.

3. The auto-positioning structure as claimed in claim 2, wherein the press front portion comprises two extending tabs to form a press notch corresponding to a width of the unlock spring sheet, the press notch holds the unlock spring sheet, and the press front portion presses the unlock spring sheet.

4. The auto-positioning structure as claimed in claim 3, wherein the upper cover comprises two pivot portions pivoted to two pivot seats of the base, and a middle plate is disposed between the pivot seats to engage the extending tabs.

* * * * *